United States Patent [19]

Holt et al.

[11] 4,333,382

[45] Jun. 8, 1982

[54] BOOST ASSISTED MISSILE LAUNCHER

[75] Inventors: Lloyd J. Holt, China Lake; Clayton E. Panlaqui, Ridgecrest, both of Calif.

[73] Assignee: The United States of America as represented by the Secretary of the Navy, Washington, D.C.

[21] Appl. No.: 107,236

[22] Filed: Dec. 26, 1979

[51] Int. Cl.[3] ..... F41F 3/04

[52] U.S. Cl. ..... 89/1.806; 89/1.818

[58] Field of Search ..... 89/1.818, 1.806, 1.807, 89/1.813, 1.815; 244/122 AB

[56] References Cited

U.S. PATENT DOCUMENTS

| | | | |
|---|---|---|---|
| 2,516,902 | 8/1950 | Musser | 244/122 |
| 2,591,834 | 4/1952 | Kuka | 89/1.819 |
| 2,792,755 | 5/1957 | Lahde | 89/1.819 X |
| 3,017,835 | 1/1962 | Holtz | 102/49 |
| 3,093,034 | 6/1963 | Wermager et al. | 89/1.8 X |
| 3,125,851 | 3/1964 | Rubinstein et al. | 89/1.806 |
| 3,134,300 | 5/1964 | Shlesinger | 89/1.819 |
| 3,135,161 | 6/1964 | Oyhus | 89/1.818 |
| 3,160,062 | 12/1964 | Moy et al. | 89/1.818 |
| 3,218,849 | 11/1965 | Marvinney et al. | 89/1.806 X |
| 3,267,809 | 8/1966 | Sikora | 89/1.819 |
| 3,282,161 | 11/1966 | MacDonald et al. | 89/1.818 |
| 3,442,473 | 5/1969 | Rivedal et al. | 244/122 |
| 3,460,430 | 8/1969 | Fisher | 89/1.818 |
| 3,548,708 | 12/1970 | Hubigh | 89/1.818 |
| 3,583,277 | 6/1971 | Crockett | 89/1.818 X |
| 3,605,549 | 9/1971 | Moskowitz et al. | 89/1.806 |
| 3,769,876 | 11/1973 | Haas et al. | 89/1.807 |
| 3,968,947 | 7/1976 | Schlegel et al. | 244/63 |
| 4,036,456 | 7/1977 | Skinner et al. | 244/122 |
| 4,040,334 | 8/1977 | Smethers | 89/1.804 |
| 4,095,762 | 6/1978 | Holt | 244/137 |

*Primary Examiner*—David H. Brown

*Attorney, Agent, or Firm*—Robert F. Beers; W. Thom Skeer; Kenneth G. Pritchard

[57] ABSTRACT

An apparatus for launching missiles from aircraft or other launching platforms without use of missile fuel is provided through hydraulic means. A hydraulic actuating system provides a high pressure piston stroke over a short distance which permits missiles to be accelerated up to launch speeds prior to initiation of the missile motor. In addition to the use of the hydraulic actuator system, the missile is mounted without external mountings on the missile which affect the aerodynamic performance.

10 Claims, 9 Drawing Figures

7B

7A

BOOST ASSISTED MISSILE LAUNCHER

BACKGROUND OF THE INVENTION

1. Field of the Invention

This invention pertains to missile launching apparatus. In particular, it pertains to self powered missile launching apparatus which accelerates the missile to launch speed during initiation of a rocket motor. In even greater particularity, the present invention pertains to boost assisted missile launchings which do not require external fasteners on missiles which interfere with aerodynamic performance.

2. Description of the Prior Art

Launching apparatus for missiles, rockets etc. are well known in the art and comprise many methods and techniques. Most of these methods however can be lumped together under the general heading of pneumatic techniques. These techniques require a high cost for maintenance, these launching systems have to be cleaned after a small number of firings. This cleaning requirement limits the number of missions aircraft can fly before maintenance must be performed.

Prior art patents include U.S. Pat. Nos. 3,605,549 to Moskowitz et al., 3,968,947 to Schlegel et al., and 4,040,334 to Smethers Jr. These prior art patents along with numerous other prior art patents rely on a compressed fluid, such as air, to propel the missile or other desired object into flight. Moskowitz et al. provides a retaining area where the exhaust gases of the rocket motor build up to a predetermined pressure such that they can overcome the effects of a restraining system and the accompanying friction and inertia of such a system. The Moskowitz et al. device results in an excessively hot launch tube along with consumption of rocket fuel prior to the rocket actually entering flight.

Schlegel et al. provides for a pneumatic launching apparatus using a propelling tube which is driven forward under pressure from a supporting system. This invention conserves the onboard fuel supply of the launched aircraft until it is inflight. For any heavy object, the length of the launching tube becomes prohibitively long resulting in loss of pressure as the launching tube extends.

The Smethers patent provides the means for launching missiles from an aircraft through a tube. The missiles are propelled out of the tube by compressed air which permits a higher initial velocity on the missile being launched. The greater velocity and conserved fuel permits a greater range for the missile.

These and numerous other prior art devices all seek to overcome the basic problems of missile launch from aircraft. These problems include avoiding physical bumping of the missile and aircraft, fuel consumption by the missile to obtain free flight, guidance control of the missile to offset uneven flight dynamics caused by external fasteners and scorching of the aircraft by missile exhaust.

The most common technique for launching missiles requires some sort of rail launcher or bomb rack attachment carried underneath the wings of the aircraft which is uniquely designed to the particular type of missile to be launched. The missile is aimed or locked on target and then fired through connecting electronics which ignite the rocket motor of the missile in question. The thrust provided by the missile is required to overcome the moment of inertia aerodynamic drag and static friction inherent in breaking free of any launch track as well as overcoming the restraining force of any safety devices used to lock the missile in place prior to launch. These launch requirements result in the missile consuming a significant percentage of its initial fuel supply to become airborne. This results in reduction of the possible range the missile could otherwise attain. Furthermore, the missile requires some sort of fastening or coupling to attach it to the aircraft prior to launch. These couplings, which have always been external, are further constrained by the need to hold the ordnance at a reasonable distance from the airfoil of the aircraft such that air turbulence during the initial moments of launch does not cause the missile to be bounced against the aircraft. Such contact causes damage to both the missile and the aircraft. Fasteners on the external surfaces of the missile further increase aerodynamic drag on the missile resulting in decreased range capability. Furthermore, the external fasteners result in unbalanced air flow around the missile which require compensation through guidance mechanisms within the missile.

SUMMARY OF THE INVENTION

A missile suspension system is provided which includes expandable plugs inserted into the missile body itself. These plugs can be mechanically or pneumatically activated to expand when inserted thus locking the missile to the launching mechanism. The plugs are inturn fastened to supports by linear bearings which are mounted on internal guide rails within the missile launcher.

The supports are adjacent to a telescoping piston assembly within the missile launcher. Upon reaching launch conditions, a pneumatic/hydraulic actuating system is utilized to systematically and sequencially remove all restraining supports holding the missile to the launcher and produce a short power stroke which moves the missile forward as the support elements travel along the guide rails. An inert gas medium is used to launch the missile which is not lost upon launch. The aircraft can recycle the gas to a compressed state while returning to base. Upon landing, a new missile can be attached to the launcher and the aircraft can takeoff again. No cleaning or maintenance has to be performed on the launcher.

The plugs are connected through the support members by a guidance means which is mounted in a groove on the structure of the launcher. This groove curves away from the missile at the end of the piston stroke. As the piston nears the end of its stroke, the insert is withdrawn towards the aircraft and out of the missile leaving the missile in free flight at a predetermined velocity. If the missile motor fails, the missile has still been ejected from the aircraft. The aircraft does not have to land with a malfunctioning missile.

The rocket motor within the missile can be timed to either ignite during the launch process or upon the missile achieving free flight. As a result of this time delay, no fuel is consumed by the rocket motor prior to the missile achieving free flight. The supporting holes in the missile for the plugs can have an automatic closure means attached to them such that a smooth aerodynamic surface on the missile is achieved when the missile is launched.

DESCRIPTION OF THE PREFERRED EMBODIMENT

Figure 1:
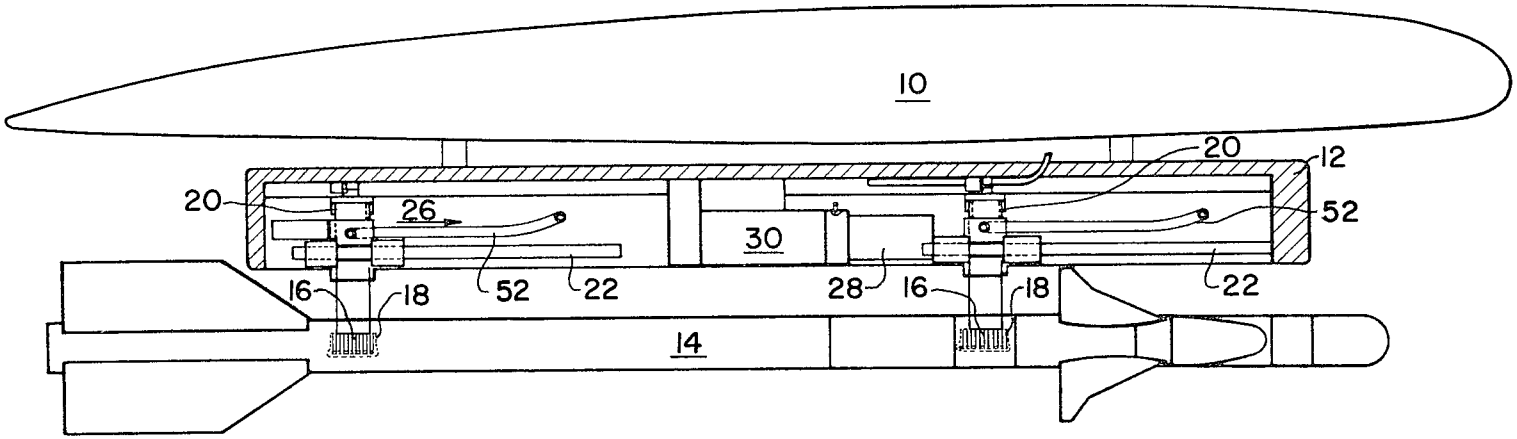
FIG. 1 shows a missile mounted to the present invention.

In FIG. 1, an aircraft wing 10 is shown with a missile launcher 12 which is connected to a missile 14. Holding missile 14 to launcher 12 is an insertion means 16 which fits into a recessed opening 18 on missile 14. Insertion means 16, normally an expandable plug, are part of support means 20 which hold missile 14 to launcher 12. Missile 14 is shown farther from launcher 12 than it would otherwise be. In an operating model, there is very little space between the two. Support means 20 are mounted on internal rails 22 and track along rails 22 and guide groove 52 in the direction of arrow 26. A drive means 28 powered by a power supply 30 drives support means 20 along rails 22.

Figure 2:
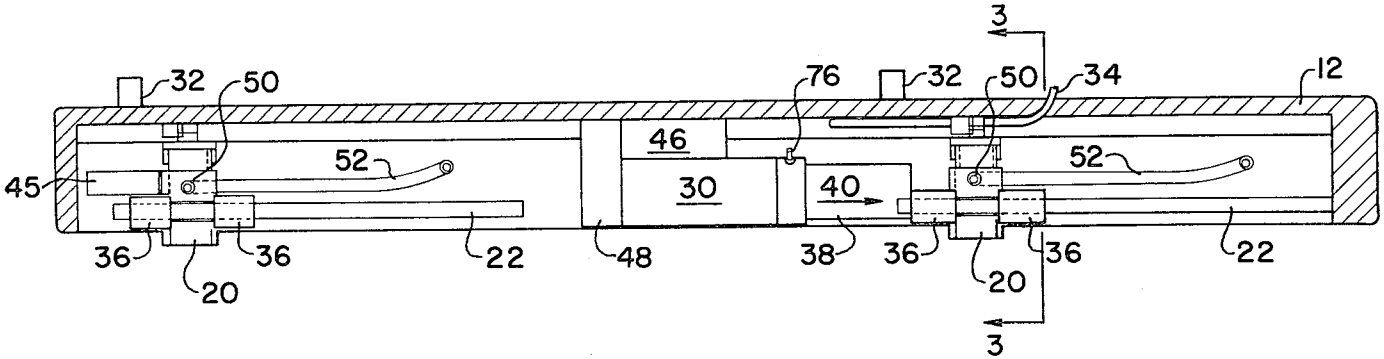
FIG. 2 shows a closeup of the present invention.

In FIG. 2, one embodiment of a boost assisted missile launcher is shown. Throughout the following description, like numbers in different figures refer to the same components shown in previous figures. Launcher 12 with support means 20 is designed to be mounted to an aircraft by connectors 32 which can be bolts or any other appropriate fastening devices.

Support means 20 serve as suspension and release carriages for holding a missile to launcher 12. At least one support means 20 can have a hollow core to permit an electrical or fiber optic umbilical 34 to pass down through the center of support means 20 into the missile. This permits power to the missile to be provided from the aircraft prior to launch. It also permits feedback from the missile so the pilot can monitor the missile.

Support means 20 contains linear bearings 36 which travel along guide rails 22. Guide rails 22 are mounted in two pairs. In FIG. 2, the second guide rail in each pair is hidden behind the guide rail shown.

Adjacent to one support means 20 is a telescoping piston assembly 38 which upon expansion drives support means 20 in the direction of arrow 40. Piston assembly 38 is one form of drive means 28 in FIG. 1 that can be used in the present invention. Upon expansion of piston assembly 38, the attached missile is given a forward velocity. The exact magnitude of the velocity is a function of the pressure used in driving telescoping piston assembly 38. Driving telescoping piston assembly 38 is power supply 30 which can in turn be activated or receive power from the aircraft itself.

In addition to the boost assist mechanism, the missile will also require some form of hold back release mechanism 45 which can also serve as sway bracing to firmly anchor the missile to launcher 12. To unlock hold back release mechanism 45 as well as disconnect electrical umbilical 34 and support means 20 from the missile itself, a sequencing mechanism 46 and an initiator assembly 48 are connected to the power system to provide proper timing and order of events to launch the missile. A cam bearing 50 is mounted on each side of support mechanism 20 and fits into guide groove 52 on each side of support mechanism 20 within launcher 12. Guide groove 52 curves upward at the end of the piston stroke such that support mechanism 20 is withdrawn upward out of the missile releasing it to free flight.

Figure 3:
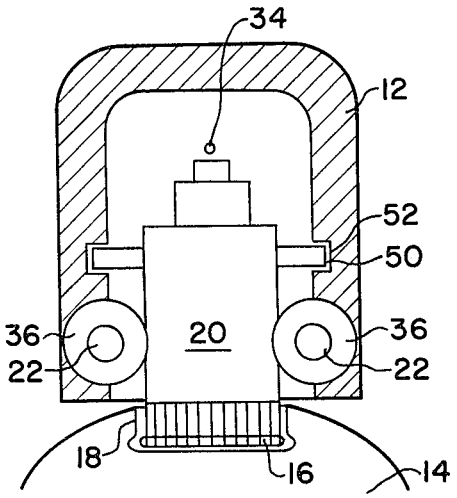
FIG. 3 shows a cross section of a missile attached to the present invention.

In FIG. 3, a cross sectional view of the present invention is shown along arrows 3—3 of FIG. 2. Support mechanism 20 is now shown inserted into missile 14 through opening 18 which contains insert 16. Missile 14 is shown in a more realistic spacing from launcher 20 than as shown in FIG. 1. As shown, insert 16 is slotted to permit ease of expansion when pressure within support mechanism 20 is applied. Upon release of pressure, the slotted area of insert 16 readily collapses inward permitting support mechanism 20 to be drawn upward out of missile 14. Two cam followers 50 are shown within guide grooves 52.

Figure 4:
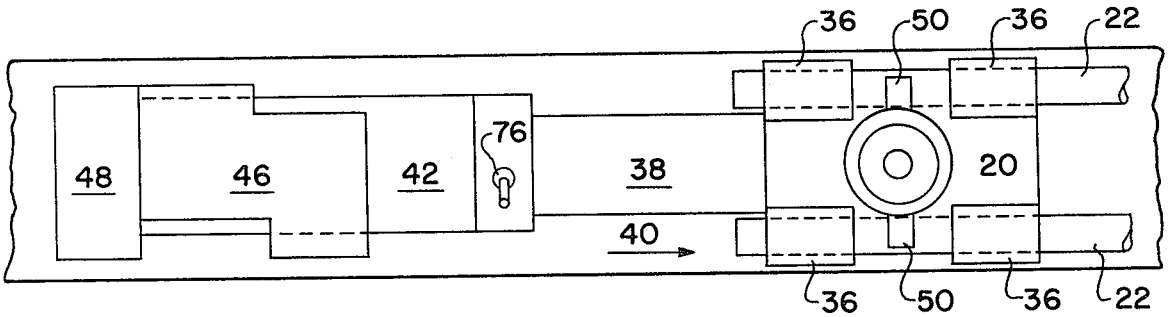
FIG. 4 shows an additional view of the present invention.

FIG. 4 shows a top view of one section of the preferred embodiment shown in FIG. 2. FIG. 4 shows the arrangement of a pair of guide rails 22 connected to support mechanism 20 by four linear bearings 36 which are permitted to travel in the direction of arrow 40 when telescoping piston assembly 38 expands.

Figure 5:
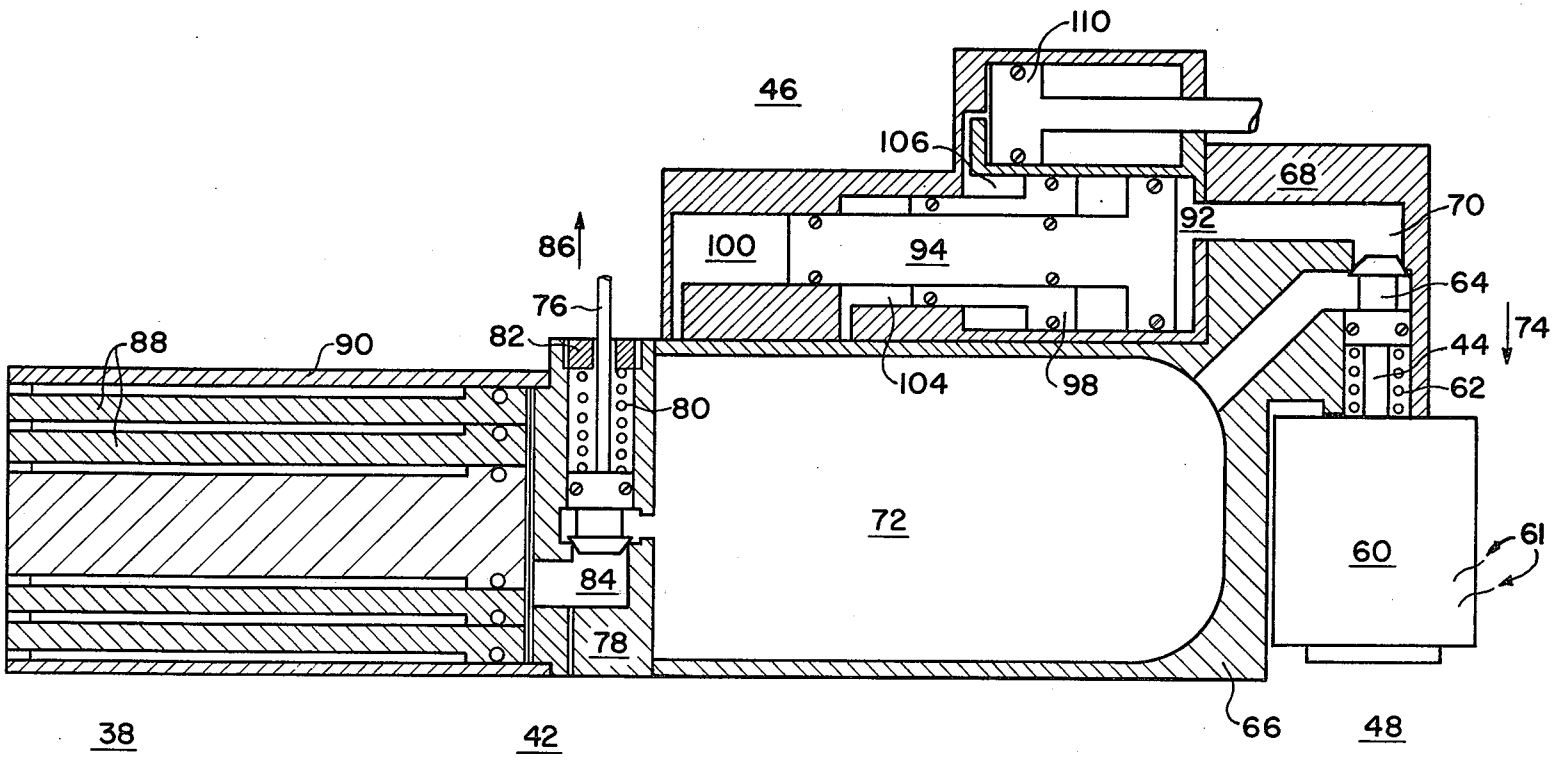
FIG. 5 shows the pneumatic/hydraulic actuator system of the present invention.

FIG. 5 is a cross section which includes the initiator assembly shown generally in FIG. 2 and FIG. 4 as 48 as well as power system 42. Initiator assembly 48 starts with a solenoid valve 60 which is used to start the missile eject launcher sequence. Solenoid 60 is connected by a rod 44 supported by a spring 62 to a poppet valve 64. Solenoid 60 is activated by a launch signal from the aircraft. Wire leads 61 connect solenoid 60 to power supply 30 shown in FIG. 1. Poppet valve 64 is installed within a pressure vessel 66 which has an end housing 68. Poppet valve 64 seals off a passage 70 from pressurized gas contained in a vessel 72. A gas is merely exemplary. Any fluid media can be used. When a release signal is applied to solenoid valve 60, poppet valve 64 is withdrawn in the direction of arrow 74 allowing gas from vessel 72 to flow through passage 70 to sequencing mechanism 46. Sequencing mechanism 46 contains a hydraulic actuator system which releases sway bracing, unlocks the support mechanism, energizes the power system and releases the hold back release mechanism. Upon release of the hold back releasemechanism, the power system extends telescoping piston assembly 38 driving support mechanism 20 forward along guide rails 22 as shown previously.

To do this, power system 42 shown generally in FIG. 5, contains another poppet valve 76 which is seated within poppet housing 78 by a spring 80 and secured by some form of seal such as a retaining nut 82. Pressurized gas from vessel 72, which can be an inert gas such as nitrogen known as $GN_2$, is permitted to flow through passage 84 when poppet valve 76 is withdrawn in the direction of arrow 86. The diameter of poppet valve 76 is balanced so only spring 82 is needed to maintain closure. When poppet valve 76 is withdrawn, pressurized gas enters passage 84 and extends telescoping piston assembly sections 88 which are contained within assembly housing 90. Pressurized vessel 72 can also function properly if it contains a hydraulic oil integrated with the aircraft system. Pyrotechnic devices can also be used.

Figure 6:
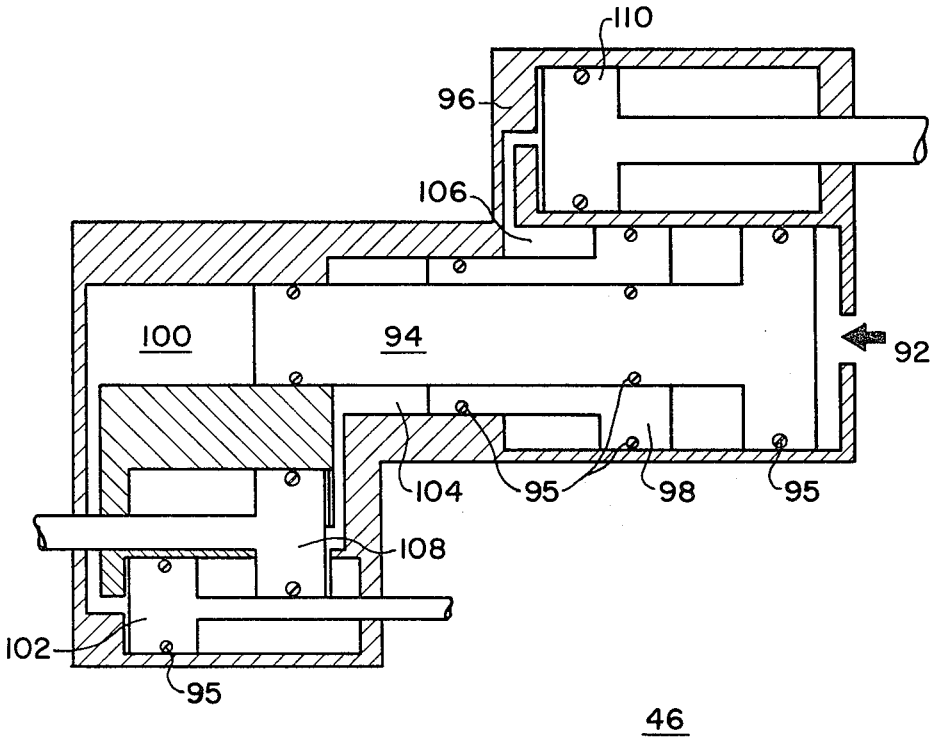
FIG. 6 shows the sequencing mechanism of the hydraulic actuator system.

FIG. 6 shows a detailed cross sectional view of sequencing mechanism 46 which can be used with the present invention. Pressurized gas enters at 92. A piston 94 moves within a housing 96 until contact with another piston 98 is made. During this time hydraulic oil in the hydraulic reservoir 100 is displaced moving piston 102 which will unlock the system. Piston 94 and piston 98 continue to move within housing 96 displacing hydraulic oil from chambers 100, 104 and 106. Hydraulic oil from chamber 100 continues the motion of piston 102 and retracts the sway bracing system. Hydraulic oil from a chamber 104 displaces piston 108. As piston 108 moves it unlatches the support mechanism 20 and energizes the power system via poppet valve 76. Hydraulic oil from chamber 106 displaces piston 110 which releases the hold back release mechanism 45. The displacing motion of pistons 102, 108 and 110 perform various functions simultaneously and in sequence. Poppet valve 76 is operated by a mechanical linkage to the unlatched power system piston 108 of the sequencing mechanism. All of the above pistons can contain O-rings 95 to aid smooth movement with tight seals.

Figure 7:
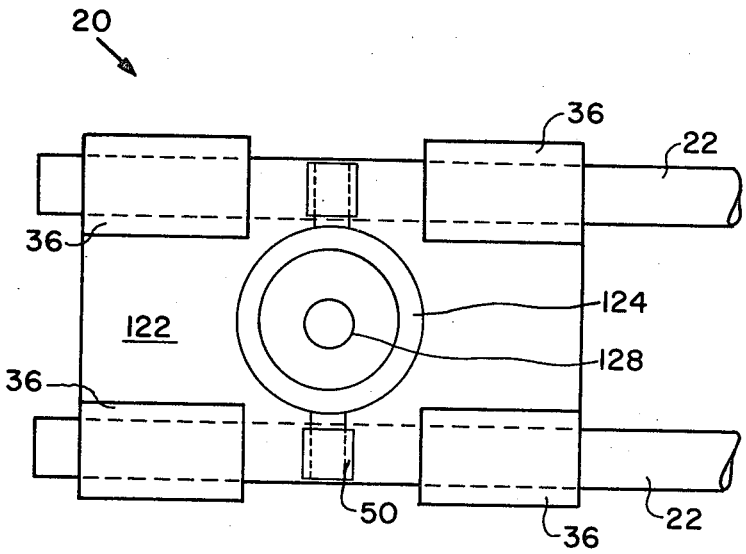
FIGS. 7*a* and 7*b* show the support means for the present invention.
Figure 7:
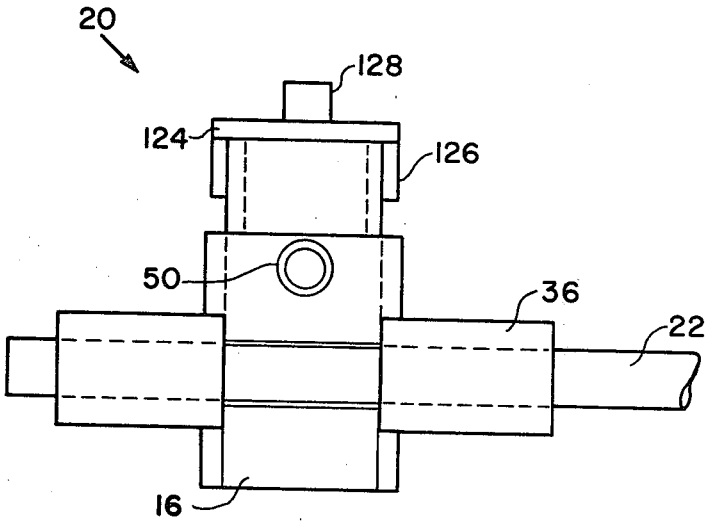

FIGS. 7*a* and 7*b* show a detailed view of support mechanism 20. An missile attachment plug 16 is secured to a carriage 122. Four linear ball bearings 36 are attached to carriage 122 and are mounted on two parallel guide rods 22 as described previously. Attachment plug 16, a latching mechanism 124 and a locking system 126 secure the missile after loading. Missile power, coolant, data communications and motor ignition control are provided through center column 128. Center column 128 permits passage of electrical umbilical 34 shown in FIG. 3. Support mechanism 20 includes components 16, 36, 50, 122, 124, 126, and 128.

Figure 8:
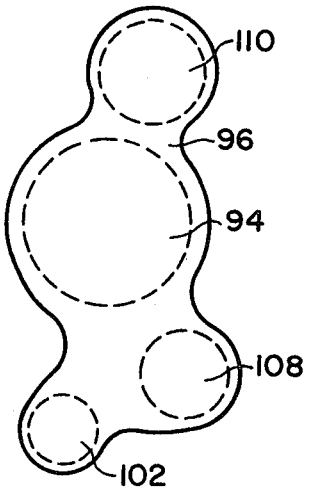
FIG. 8 shows an end on cross section of FIG. 6.

FIG. 8 shows a side view of FIG. 6. The staggered arrangement of pistons 94, 102, 108 and 110 shows that each has room to function independently of the others.

The above description can obviously be modified in many of its mechanical details and applications to create similar systems which operate on the principles disclosed here.

What is claimed is:

1. A boost assisted missile launcher for launching missiles from aircraft comprising:

support means mounted within the launcher for holding the missile until missile launch is desired;

guide means connected to said support means for launching said missile along a predetermined path;

drive means for propelling said missile along said guide means;

a telescoping piston assembly mounted to said support means for driving said missile to a predetermined velocity;

a hydraulic actuator system with at least one input for expanding said telescoping piston;

a pressurized vessel for a fluid media with at least one input to said hydraulic actuator system for activating said system;

a poppet valve placed between said pressurized vessel and said hydraulic actuator system for preventing activation until a predetermined time;

a solenoid, electronically connected to said power supply and placed about said poppet valve so as to open said poppet valve when said solenoid is triggered by said power supply; and a power supply connected to said drive means for triggering said drive means.

2. A boost assisted missile launcher as described in claim 1, wherein said guide means comprises at least one linear bearing mounted to said support means and at least one guide rail in said linear bearing for determining the direction of launch.

3. A boost assisted missile launcher as described in claim 2 wherein said drive means comprises:

a telescoping piston assembly mounted to said support means for driving said missile to a predetermined velocity;

a hydraulic actuator system with at least one input for expanding said telescoping piston;

a pressurized vessel for a fluid media with at least one input to said hydraulic actuator system for activating said system;

a poppet valve placed between said pressurized vessel and said hydraulic actuator system for preventing activation until a predetermined time; and a solenoid, electronically connected to said power supply and placed about said poppet valve so as to open said poppet valve when said solenoid is triggered by said power supply.

4. A boost assisted missile launcher as described in claim 1 wherein said hydraulic actuator system comprises:

means for holding said missile from launching until said hydraulic actuator system is activated; and means for sequencing the release of said locking means, holding means and expansion of said telescoping piston assembly in a predetermined manner.

5. A boost assisted missile launcher as described in claim 3 wherein said hydraulic actuator system comprises:

means for holding said missile from launching until said hydraulic actuator system is activated; and means for sequencing the release of said locking means, holding means and expansion of said telescoping piston assembly in a predetermined manner.

6. A boost assisted missile launcher as described in either claim 4 or claim 5 wherein said means for sequencing comprises a plurality of pistons.

7. A boost assisted missile launcher as described in any of claims 2, 3 or 5 wherein the number of guide rails is two and the number of linear bearings is four.

8. A boost assisted missile launcher as described in any of claims 1, 3, 4 or 5 wherein said pressurized vessel uses gas as a working fluid.

9. A boost assisted missile launcher as described in either claim 4 or 5 wherein said locking means comprises an expandable insert that fits into an opening in said missile such that no external fasteners are required on said missile.

10. A boost assisted missile launcher as described in any of claims 1, 3, 4 or 5 wherein said pressurized vessel uses nitrogen gas as a working fluid.

* * * * *